US008574095B2

(12) United States Patent
Hirano

(10) Patent No.: US 8,574,095 B2
(45) Date of Patent: Nov. 5, 2013

(54) GOLF CLUB HEAD

(75) Inventor: Tomoya Hirano, Kobe (JP)

(73) Assignee: SRI Sports Limited, Kobe (JP)

( * ) Notice: Subject to any disclaimer, the term of this patent is extended or adjusted under 35 U.S.C. 154(b) by 6 days.

(21) Appl. No.: 13/301,513

(22) Filed: Nov. 21, 2011

(65) Prior Publication Data

US 2012/0129627 A1 May 24, 2012

(30) Foreign Application Priority Data

Nov. 22, 2010 (JP) ..... 2010-260340

(51) Int. Cl.
*A63B 53/04* (2006.01)

(52) U.S. Cl.
USPC ..... 473/329; 473/345; 473/346

(58) Field of Classification Search
USPC ..... 473/345, 346, 349, 329, 324, 342, 473/287–292
See application file for complete search history.

(56) References Cited

U.S. PATENT DOCUMENTS

| | | | | |
|---|---|---|---|---|
| 4,214,754 | A * | 7/1980 | Zebelean | 473/346 |
| 5,419,559 | A * | 5/1995 | Melanson et al. | 473/346 |
| 5,482,279 | A * | 1/1996 | Antonious | 473/327 |
| 5,547,427 | A * | 8/1996 | Rigal et al. | 473/345 |
| 5,908,356 | A * | 6/1999 | Nagamoto | 473/224 |
| 6,527,650 | B2 * | 3/2003 | Reyes et al. | 473/345 |
| 6,595,871 | B2 * | 7/2003 | Sano | 473/342 |
| 6,645,087 | B2 * | 11/2003 | Yabu | 473/342 |
| 6,852,038 | B2 * | 2/2005 | Yabu | 473/224 |
| 7,303,488 | B2 * | 12/2007 | Kakiuchi et al. | 473/346 |
| 7,431,668 | B2 * | 10/2008 | Tateno et al. | 473/346 |
| 7,435,191 | B2 * | 10/2008 | Tateno et al. | 473/346 |
| 7,442,132 | B2 * | 10/2008 | Nishio | 473/342 |
| 7,445,564 | B2 * | 11/2008 | Kusumoto | 473/346 |
| 7,614,964 | B2 * | 11/2009 | Matsunaga | 473/342 |
| 7,618,331 | B2 * | 11/2009 | Hirano | 473/329 |
| 7,641,568 | B2 * | 1/2010 | Hoffman et al. | 473/327 |
| 7,762,909 | B2 * | 7/2010 | Sugimoto | 473/346 |
| 8,353,784 | B2 * | 1/2013 | Boyd et al. | 473/334 |
| 2003/0144079 | A1 | 7/2003 | Yoneyama | |
| 2008/0214322 | A1 * | 9/2008 | Chou et al. | 473/346 |
| 2008/0220894 | A1 * | 9/2008 | Matsunaga et al. | 473/346 |
| 2009/0253533 | A1 | 10/2009 | Hirano | |

FOREIGN PATENT DOCUMENTS

| | | | |
|---|---|---|---|
| JP | 2002-315854 | A | 10/2002 |
| JP | 2006-175135 | A | 7/2006 |

* cited by examiner

*Primary Examiner* — Sebastiano Passaniti
(74) *Attorney, Agent, or Firm* — Birch, Stewart, Kolasch & Birch, LLP

(57) ABSTRACT

A golf club head comprises has an inner surface including a back surface of the face portion that is provided with a crown-side thick-walled rib and a sole-side thick-walled rib. The crown-side thick-walled rib includes an upper face rib disposed in the face portion and extending from the central thick-walled part to a peripheral edge of the back surface of the face portion on a crown portion side, and a crown rib disposed in the crown portion and extending backwardly of the head from the upper face rib. The sole-side thick-walled rib includes a lower face rib disposed in the face portion and extending from the central thick-walled part to a peripheral edge of the back surface of the face portion on a sole portion side, and a sole rib disposed in the sole portion and extending backwardly of the head from the lower face rib.

4 Claims, 9 Drawing Sheets

GOLF CLUB HEAD

BACKGROUND OF THE INVENTION

1. Field of the Invention

The present invention relates to a golf club head durability of which has been improved by providing a crown-side thick-walled rib and a sole-side thick-walled rib on an inner surface of the head.

2. Description of the Background Art

In recent years have been proposed various golf club heads having a hollow structure including a face portion including a central thick-walled part with a large thickness and a peripheral thin-walled part with a small thickness which surrounds the central thick-walled part (see Japanese Patent Application Publication No. 2002-315854). Such a golf club head has an advantage that because of presence of the peripheral thin-walled part, reduction of resilience performance can be controlled even during a mishit in which a golf ball is hit at a position which is off a center of a face. However, such a face portion tends to have low durability at a boundary part between the central thick-walled part and the peripheral thin-walled part.

In order to prevent the drawback as described above, structure of the face portion in which a plurality of reinforcing ribs radially extends from the central thick-walled part is proposed (see Japanese Patent Application Publication No. 2003-290398 or Japanese Patent Application Publication No. 2009-247497). However, since any reinforcing ribs in these heads terminate within the face, there is further room for improvement in durability.

SUMMARY OF THE INVENTION

The present invention has been made in light of the actual circumstances described above, and a principal object of the present invention is to provide a golf club head which can improve durability basically by providing in an inner surface of the head a crown-side thick-walled rib which extends from a central thick-walled part provided in a central region of a face portion to a side of a back face in a crown portion beyond a face and a sole-side thick-walled rib which extends from the central thick-walled part to the side of the back face in a sole portion beyond the face.

According to the present invention, a golf club head having a hollow structure comprises a face portion which has a face to hit a golf ball, a crown portion which connects to an upper edge of the face and forms a top surface of the head, a sole portion which connects to a lower edge of the face and forms a bottom surface of the head, and a side portion between the crown portion and the sole portion, which extends from a toe-side edge of the face to a heel-side edge of the face through a back face of the head, wherein the face portion is provided in a central region thereof with a central thick-walled part having a thickness of 3.1 to 4.2 mm, and an inner surface of the head including a back surface of the face portion is provided with a crown-side thick-walled rib and a sole-side thick-walled rib, the crown-side thick-walled rib including an upper face rib which is disposes in the face portion and extends from the central thick-walled part to a peripheral edge of the back surface of the face portion on a crown portion side, and a crown rib which is disposed in the crown portion and extends backwardly of the head from the upper face rib, and the sole-side thick-walled rib including a lower face rib which is disposes in the face portion and extends from the central thick-walled part to a peripheral edge of the back surface of the face portion on a sole portion side and a sole rib which is disposed in the sole portion and extends backwardly of the head from the lower face rib.

In a golf club head of the present invention, a central thick-walled part with a thickness of 3.1 to 4.2 mm is provided in a central region of a face portion. Such a golf club head improves durability of the central region of the face portion which is subjected to the greatest impact during hitting. In addition, an inner surface of the head including a back surface of the face portion has a crown-side thick-walled rib including an upper face rib which extends from the central thick-walled part to a peripheral edge of the back surface of the face portion on a side of a crown portion and a crown rib which connects to the upper face rib and extends to a side of a back face in the crown portion, and a sole-side thick-walled rib including a lower face rib which extends from the central thick-walled part to a peripheral edge of the back surface of the face portion on a side of a sole portion and a sole rib which connects to the lower face rib and extends to the side of the back face in the sole portion. A golf club head having such ribs not only effectively reinforces a boundary part between the face portion and the sole portion and a boundary part between the face portion and the crown portion where a strain is easy to concentrate, but also can reinforce the crown portion or sole portion simultaneously. Therefore, the golf club head of the present invention has improved durability.

DESCRIPTION OF THE PREFERRED EMBODIMENTS

One embodiment of the present invention will be described hereinafter based on the drawings.

Figure 5:
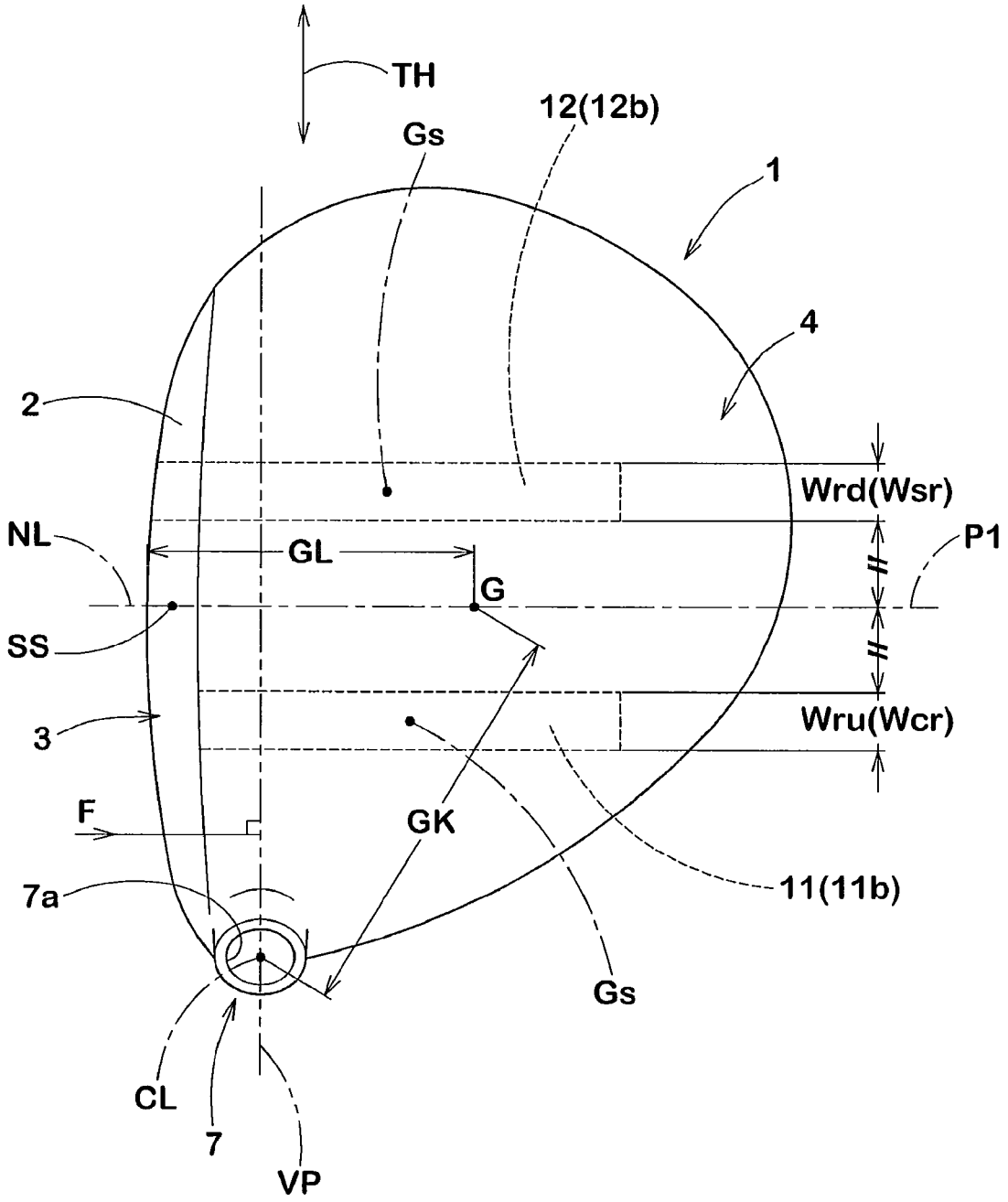
FIG. 5 is a plane view showing a head in a reference state.

It is assumed that a head 1 in each figure is placed in a reference state. Here, the reference state shall be a state in which, as shown in FIG. 5, the club head 1 is in contact with the ground on a horizontal plane HP, with a shaft axis centerline CL arranged in any vertical plane VP and held to a lie angle and a loft angle defined for the club head 1. Then, unless otherwise noted, a description will be given assuming that the club head 1 is in such a reference state.

The golf club head (which may be hereinafter simply referred to as a "head" or a "club head") 1 of the embodiment is formed as a wood type which includes a face portion 3 having on a front side a face 2 which is a surface to hit a golf ball, a crown portion 4 connecting to an upper edge 2*a* of the face 2 and forming a top surface of the head, a sole portion 5 connecting to a lower edge 2*b* of the face 2 and forming a bottom surface of the head, a side portion 6 extending through a back face BF from a toe side edge 2*c* of the face 2 to a heel side edge 2*d* between the crown portion 4 and the sole portion 5, and a hosel portion 7 with a shaft insertion hole 7*a* to which a shaft (not shown) is mounted, and inside of which a hollow part (i) is provided. In addition, when no shaft is mounted to the club head 1, a centerline of the shaft insertion hole 7*a* is used as the shaft axis centerline CL.

From a standpoint of improving directionality of a hit golf ball by increasing moment of inertia and the depth of the center of gravity, it is desired that the volume of the club head 1 is preferably 380 $cm^3$ or more, more preferably 400 $cm^3$ or more, and even more preferably 420 $cm^3$ or more. On the other hand, since there are problems of degradation of swing balance, reduction of durability, violation of golf rules and the like as the volume of the club head 1 increases, it is desired that the volume of the club head 1 is preferably 470 $cm^3$ or less and more preferably $460^3$ cm or less. The head volume herein shall be the volume of the entire head surrounded by outer surfaces of the head obtained by filling the shaft insertion hole 7*a* of a hosel portion 7.

From the standpoint of making it easier to swing in a timely manner by controlling an excessive increase in mass, while ensuring strength, it is desired that an overall weight of the club head 1 is preferably 180 g or more and more preferably 185 g or more. On the other hand, if the overall weight increases, a golfer may not follow through on his swing when swinging, thus deteriorating a flight distance or directionality of a hit ball. From such a standpoint, it is desired that the overall weight of the club head 1 is preferably 220 g or less and more preferably 215 g or less.

Figure 1:
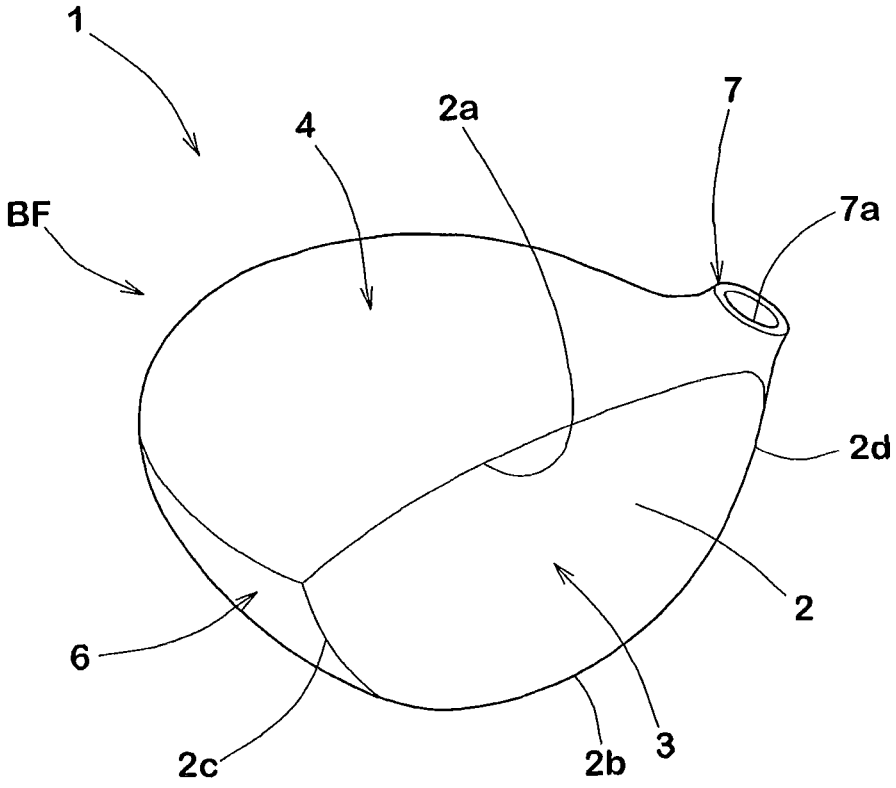
FIG. 1 is a perspective view of a head reference state, showing an embodiment of the present invention.
Figure 2:
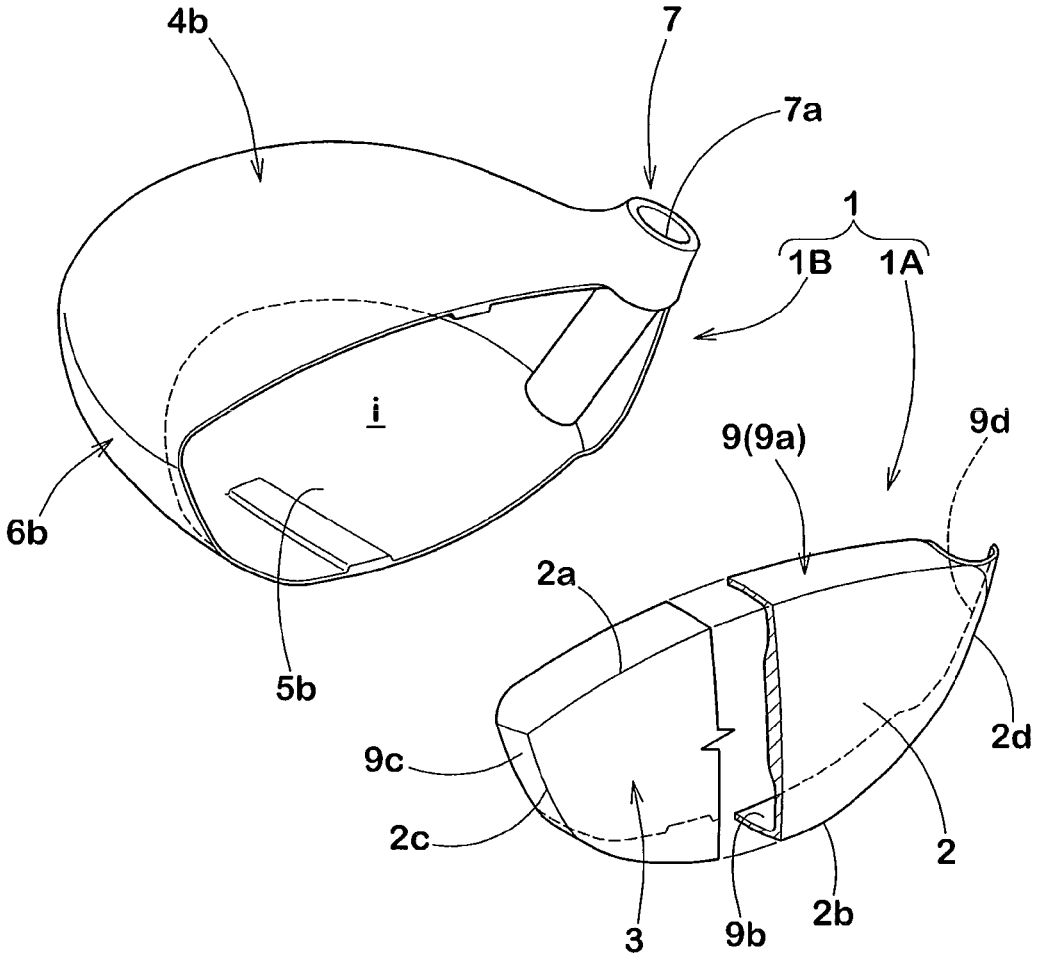
FIG. 2 is an exploded perspective view thereof.

As shown in FIG. 2, the club head 1 of the embodiment has a two-piece structure formed by welding and fixing a face member 1A made of a metallic material and a head main portion 1B made of a metallic material. However, structure of the club head 1 may be a three- or four-piece structure or structure in which a fiber-reinforced resin (not shown) is partly used in the head main portion 1B.

In the embodiment, for example, the face member 1A is formed like an almost cup shape including a substantially entire region of the face portion 3, and an extended portion 9*b* extending backward of the head in small length from each edge 2*a*, 2*b*, 2*c* and 2*d* of the face 2. The extended portion 9 includes a crown-side extended portion 9*a*, a sole-side extended portion 9*b*, toe-side extended portion 9*c*, and a heel-side extended portion 9*d*.

The head main portion 1B is configured by integrally having a portion of the club head 1 from which the face member 1A is excluded, i.e., a crown rear 4*b*, a sole rear 5*b*, and a side rear 6*b*, which form a main part of a rear side of the crown portion 4, the sole portion 5, and the side portion 6, respectively, and including the hosel portion 7.

As a metallic material used in the face member 1A and the head main portion 1B, for example, a stainless alloy, maraging steel, titanium, a titanium alloy, a magnesium alloy or an aluminum alloy, in particular, which have great specific strength is desirable. Above all, as a titanium alloy, for example, Ti-6AI-4V, Ti-15V-3Cr-3AI-3Sn, Ti-15Mo-5Zr-3AI, or Ti-13V-11Cr-3AI and the like is preferred. In addition, although the face portion 1A and the head main portion 1B may be formed of different metallic materials, a combination of metallic materials which can be welded to each other is preferred.

Figure 3:
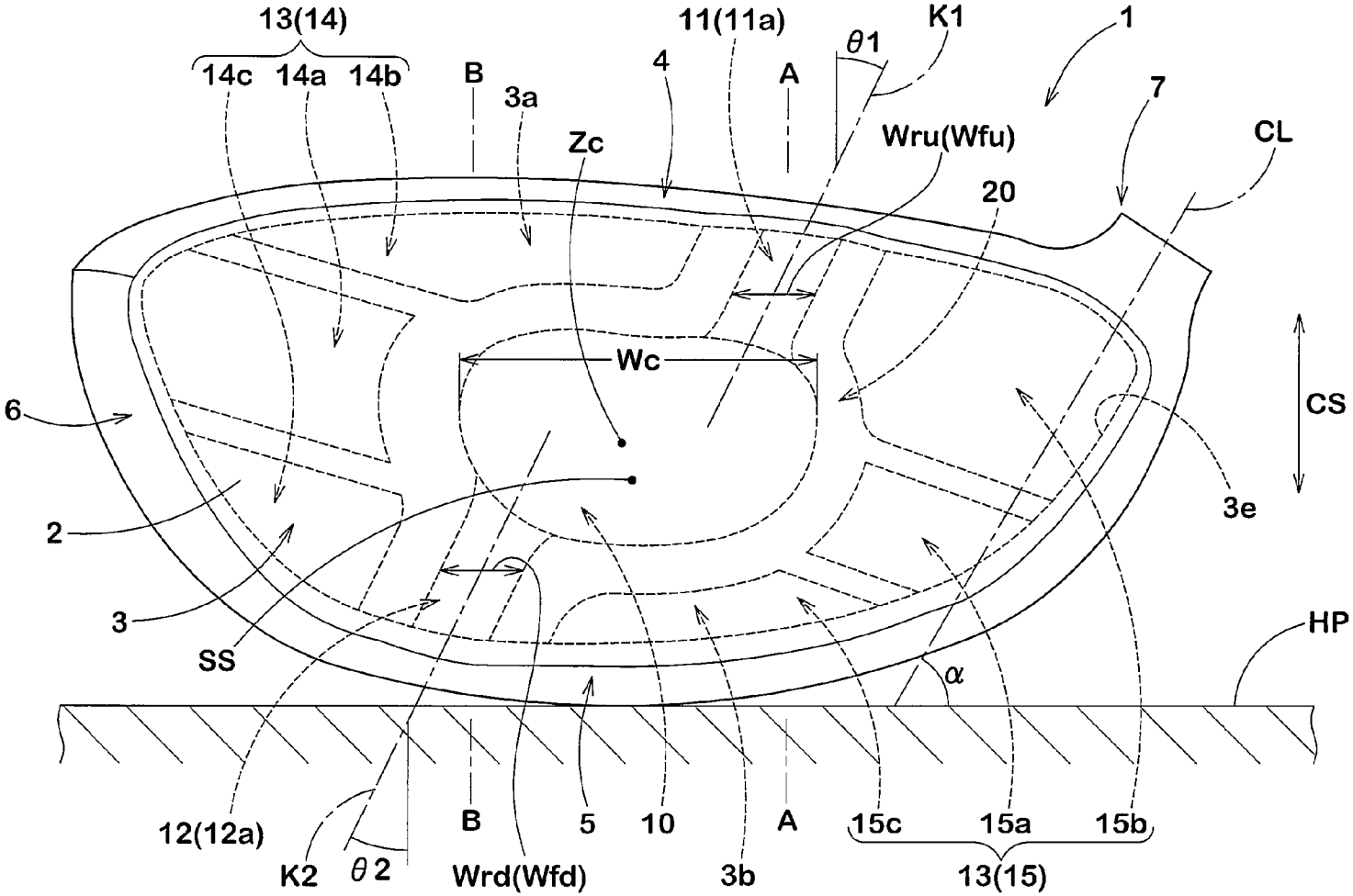
FIG. 3 is a front view of FIG. 1.
Figure 4:
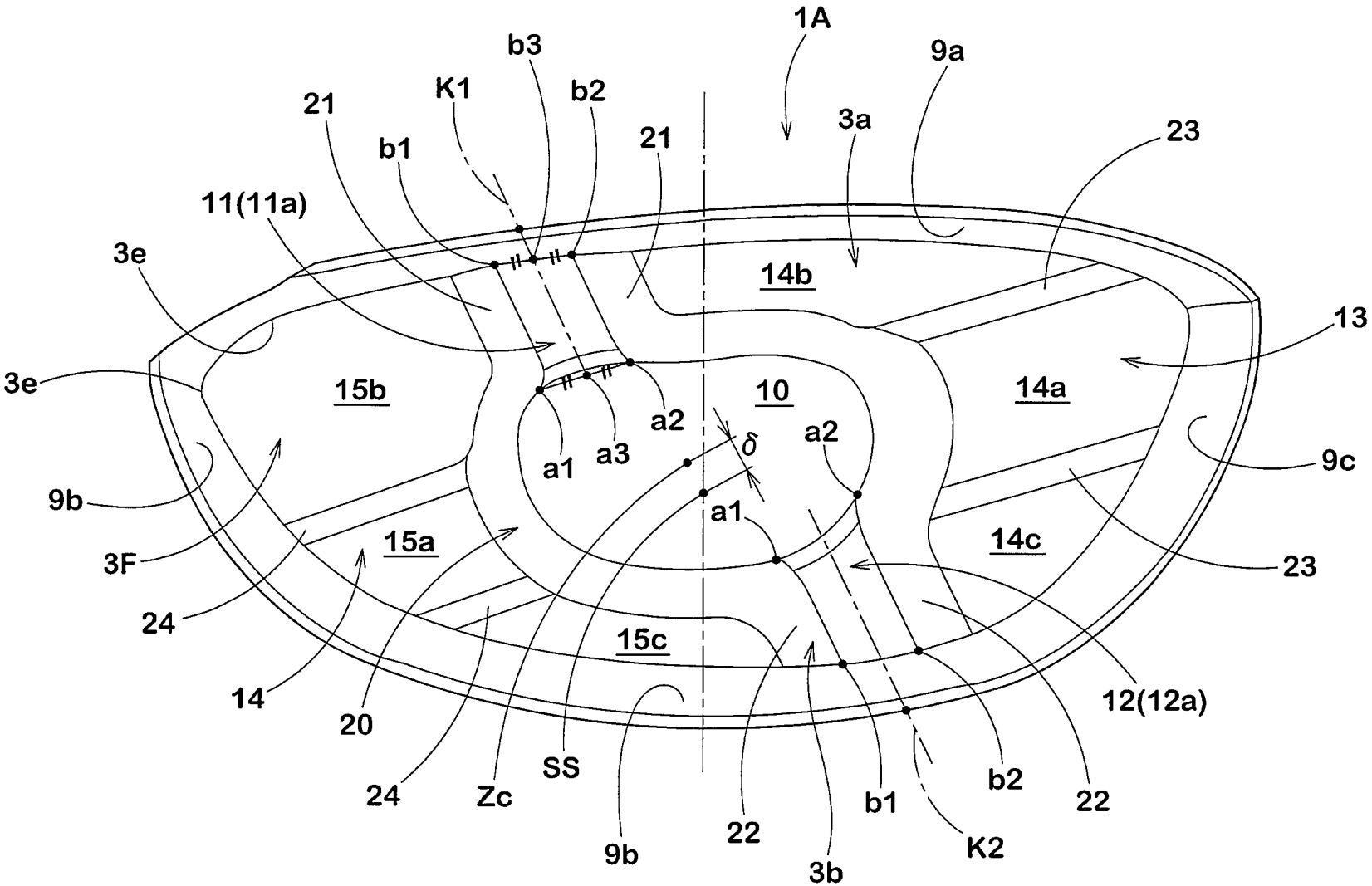
FIG. 4 is a rear view of a face member, showing a face rear.

In addition, as shown in FIG. 3 and FIG. 4, the face 2 is formed of a substantially flat surface excluding a face groove or a punch mark (any of which is not shown). On the other hand, a face back surface 3F, which is a back surface of the face portion 3, is formed of a concave-convex surface by ribs to be described below and the like.

In the embodiment, the face portion 3 includes a central thick-walled part 10 with a thickness Tc (as shown in FIG. 6) of 3.1 to 4.2 mm in its central region and a thin-walled part 13 with a thickness Tp which is smaller than the thickness Tc of the central thin-walled part 10. The central thick-walled part 10 has greatest thickness in the face portion 3. In addition, the central region of the face portion 3 is subjected to the greatest impact during hitting. Therefore, provision of the central thick-walled part 10 in the central region improves durability of the face portion 3.

When the thickness Tc of the central thick-walled part 10 is less than 3.1 mm, the central region of the face portion is susceptible to breakage or damage due to impact when a golf ball is hit, and durability deteriorates. In contrast, when the thickness Tc exceeds 4.2 mm, resilience performance deteriorates and the club mass increases, and thus easiness to swing deteriorates. From such a standpoint, it is desired that the thickness Tc is preferably 3.2 mm or more and more preferably 3.3 mm or more, and preferably 4.1 mm or less and more preferably 4.0 mm or less. In addition, in the embodiment, although the thickness Tc is formed of substantially constant thickness, it may be changed within the range, as appropriate. In addition, thickness of each portion of the face portion 3 shall be measured with the face groove or the punch mark filled.

In addition, as shown in FIG. 3 and FIG. 4, the central region of the face portion 3 is a region having constant area including a centroid shaped like a contour of the peripheral edge of the back surface of the face portion 3*e*, in a rear face (back surface) of the face portion 3 facing a side of the hollow part (i), and shall not reach the peripheral edge 3*e* of the back surface of the face portion. In addition, the peripheral edge 3*e* of the back surface of the face portion shall be a boundary line between the face back surface 3F and each inner surface of the crown portion 4, the sole portion 5, and the side portion 6. However, when the face back surface 3F and the inner surface of each portion 4 or 6 are connected by way of a chamfering like arc to avoid concentration of stress, as a matter of convenience, the peripheral edge 3*e* of the back surface of the face portion is defined as a center point of length of the arc in a head cross section.

In addition, in order to improve durability of the face portion 3 in a balanced manner, the central thick-walled part 10 of the embodiment is formed like a long ellipse or an oval in a toe-heel direction almost along the contour shape of the peripheral edge 3*e* of the back surface of the face portion. In addition, from the standpoint that can strike a balance between high durability and excellent resilience of the entire face, in the central thick-walled part 10 of the embodiment, as shown in FIG. 4, the area centroid Zc may be provided at a distance δ from a sweet spot SS which is preferably within 7 mm and more preferably within 3 mm. In addition, as shown in FIG. 5, the sweet spot SS is an intersection of a normal NL standing on the face 2 from the head center of gravity G and the face 2.

In addition, in order to improve durability of the face portion 3, easiness to swing of a golf club, and resilience performance in a balanced manner, it is desired that area of the central thick-walled part 10 is preferably 13% or more and more preferably 15% or more, and preferably 30% or less and more preferably 25% or less of the entire area of the face back surface 3F. In addition, as a matter of convenience, area of the face back surface 3F or the area Ac of the face portion 3 (in addition to these areas, this also applies to any area of each portion to be described below) shall be obtained from a two dimensional shape which is projection of a corresponding region on a vertical plane VP as shown in FIG. 5.

Figure 6A:
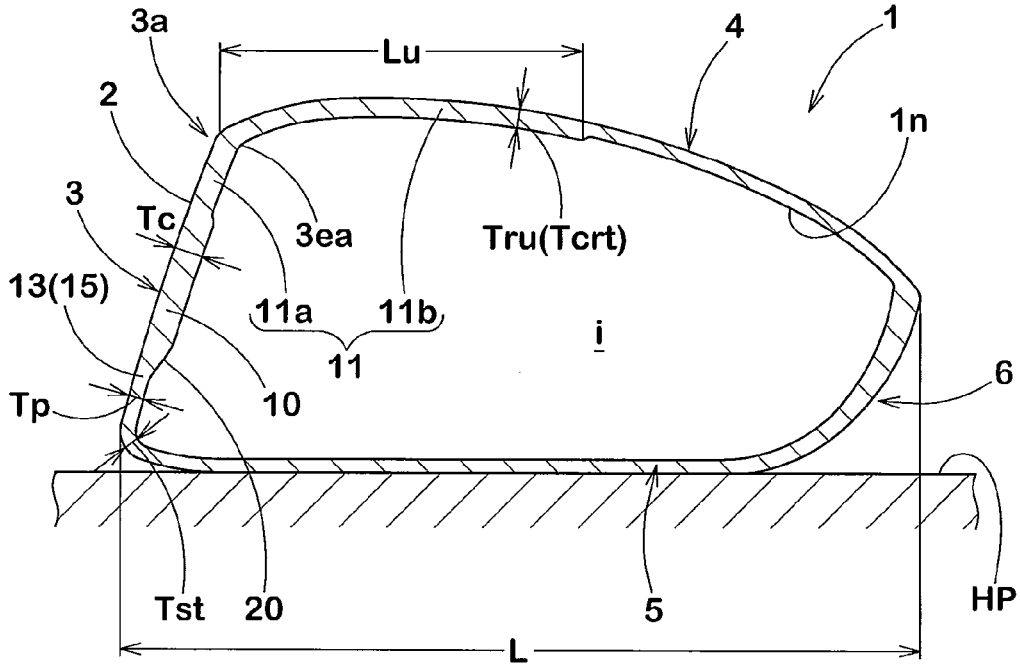
FIG. 6A is an enlarged end view taken along A-A of FIG. 3.
Figure 6B:
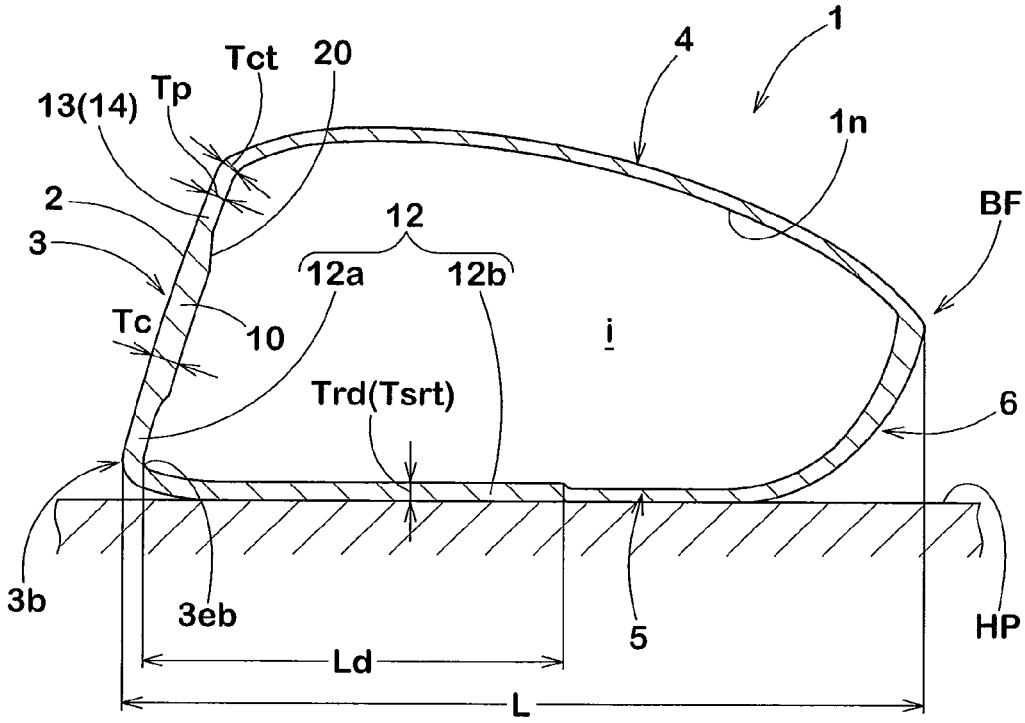
FIG. 6B is an enlarged end view taken along B-B of FIG. 3.

As shown in FIG. 6A and FIG. 6B, in the embodiment, an inner surface in of the head including the face back surface 3F has a crown-side thick-walled rib 11 including an upper face rib 11*a* which extends from the central thick-walled part 10 to a peripheral edge 3*ea* of the back surface of the face portion on a side of the crown portion and a crown rib 11*b* which connects to the upper face rib 11*a* and extends to a side of a back face BF in the crown portion 4, and a sole-side thick-walled rib 12 including a lower face rib 12*a* which extends from the central thick-walled part 10 to a peripheral edge 3*eb* of the back surface of the face portion on the side of the sole portion and a sole rib 12*b* which connects to the lower face rib 12*a* and extends to the side of the back face BF in the sole portion 5.

Such a club head 1 effectively reinforces a boundary part 3*a* of the face portion 3 and the crown portion 4 and a boundary part 3*b* of the face portion 3 and the sole portion 5 where a strain is easy to concentrate. In addition, since ribs are also provided in the crown portion 4 or the sole portion 5, front-back rigidity or torsional rigidity of the members can be reinforced simultaneously. Therefore, the golf club head 1 of the present invention has considerably improved durability. In addition, by extending the thick-walled ribs 11, 12 to the crown portion and the sole portion, vibration in the face portion 3 during an off-center shot is blocked by the central thick-walled part 10 or thick-walled ribs 11, 12 having great thickness. Thus, during an off-center shot, a vibrating region of the face portion 3 is limited to a thin-walled part 13 on a toe side part or a thin-walled part 13 on a heel side part having small thickness. Therefore, in the club head 1 of the embodiment, reduction of resilience performance during an off-center shot can be minimized. In addition, in the specification, the "rib" is one which extends with certain width on the inner surface 1*n* of the head and whose thickness is formed greater than other parts. Therefore, strength of a part in which the "rib" is provided is made higher than the other parts.

In the embodiment, it is desired that the central thick-walled part 10, the crown-side thick-walled rib 11, and the sole-side thick-walled rib 12 satisfy the following expressions (4) and (5):

$$Tc \geq Tru, Trd \quad (4)$$

$$Wc \geq Wru, Wrd \quad (5)$$

The symbols are as follows:

Tc: Thickness of the central thick-walled part (mm)

Tru: Average thickness of the crown-side thick-walled rib (mm)

Trd: Average thickness of the sole-side thick-walled rib (mm)

Wc: Maximum width of the central thick-walled part in the toe-heel direction (mm)

Wru: width of the crown-side thick-walled rib in the toe-heel direction (mm)

Wrd: width of the sole-side thick-walled rib in the toe-heel direction (mm)

More specifically, average thickness and width (this shall be maximum width when it varies) of the crown-side thick-walled rib 11 and the sole-side thick-walled rib 12 are formed to be below thickness (this shall be minimum thickness when thickness varies and applies to the following as well) and maximum width of the central thick-walled part 10. When the thickness of Tru and Trd of respective thick-walled ribs 11 and 12 become greater than the thickness Tc of the central thick-walled part 10, rigidity of a peripheral part of the central thick-walled part 10 becomes too great, which easily results in significant reduction of a flight distance during a mishit.

On the other hand, when the thickness of Tru and Trd of respective thick-walled ribs 11 and 12 is too small, durability of a peripheral region of the face portion 3 may degrade. From such a standpoint, it is desired that each of a ratio Tru/Tc of the average thickness of the crown-side thick-walled rib 11 to the thickness of the central thick-walled part 10 and a ratio Trd/Tc of the average thickness of the sole-side thick-walled rib 12 to the thickness of the central thick-walled part 10, are preferably 90% or more and more preferably 93% or more or preferably 97% or less and more preferably 95% or less. Similarly, it is desired that a ratio Wru/Wc of the width Wru of the crown-side thick-walled rib 11 to the width we of the central thick-walled part 10 and a ratio Wrd/Wc of the width Wrd of the sole-side thick-walled rib 12 to the width we of the central thick-walled part 10 are preferably 0.125 or more and more preferably 0.15 or more, or preferably 0.4 or less and more preferably 0.35 or less.

Both of the crown-side thick-walled rib 11 and the sole-side thick-walled rib 12 of the embodiment extend by the width Wru, Wrd, which are substantially constant, in the toe-heel direction. The "substantially constant" mentioned above means that the crown-side thick-walled rib 11 and the sole-side thick-walled rib 12 are formed with constant width, for 80% or more and more preferably 90% or more of length along the width centerline thereof.

As shown in FIGS. 6A and B, the upper face rib 11*a* of the embodiment extends with substantially constant thickness from the central thick-walled part 10 to the peripheral edge of the back surface of the face portion 3*ea* of the side of the crown portion. In addition, the lower face rib 12*a* of the embodiment also extends with substantially constant thickness from the central thick-walled part 10 to the peripheral edge 3*eb* of the back surface of the face portion on the side of the sole portion. Such upper face rib 11*a* and lower face rib 12*a* help in effectively improving strength in a crown-sole direction of the face portion 3 whose span is small. In addition, in the embodiment, although the upper face rib 11*a* and the lower face rib 12*a* are formed with the same thickness, they may be formed with different thicknesses. For example, by making the thickness of the lower face rib 12*a* on the side of the sole portion 5 greater than the thickness of the upper face rib 11*a*, a center of gravity can be lowered.

As shown in FIG. 3, in the head 1 of the embodiment, when it is viewed from the front in a reference state, an extended line K1, which is a width centerline of the upper face rib 11*a* extended to the sole portion 5, runs more on the heel side than an area centroid Zc of the central thick-walled part 10. On the other hand, an extended line K2, which is a width centerline of the lower face rib 12*a* extended to the side of the crown portion 4, runs more on the toe side than the area centroid Zc of the central thick-walled part 10. In other words, the area centroid Zc of the central thick-walled part 10 exists more on the toe side than the extended line K1 and more on the heel side than the extended line K2. Accordingly, the reinforcing effect by each thick-walled rib 11, 12 is distributed in the toe-heel direction and thus does not concentrate on one spot. Therefore, even if a golf ball is hit at positions of the upper face rib 11*a* and the lower face rib 12*a*, the face portion 3 can moderately bend and significant degradation of the resilience performance is controlled. This can minimize reduction in flight distances of hit golf balls even if hit ball positions fluctuate up or down. In addition, the "viewed from the front"

is specified as a shape of the head 1 when the face 2 is viewed from a direction orthogonal to the vertical plane VP as shown by a symbol F in FIG. 5.

Figure 7:
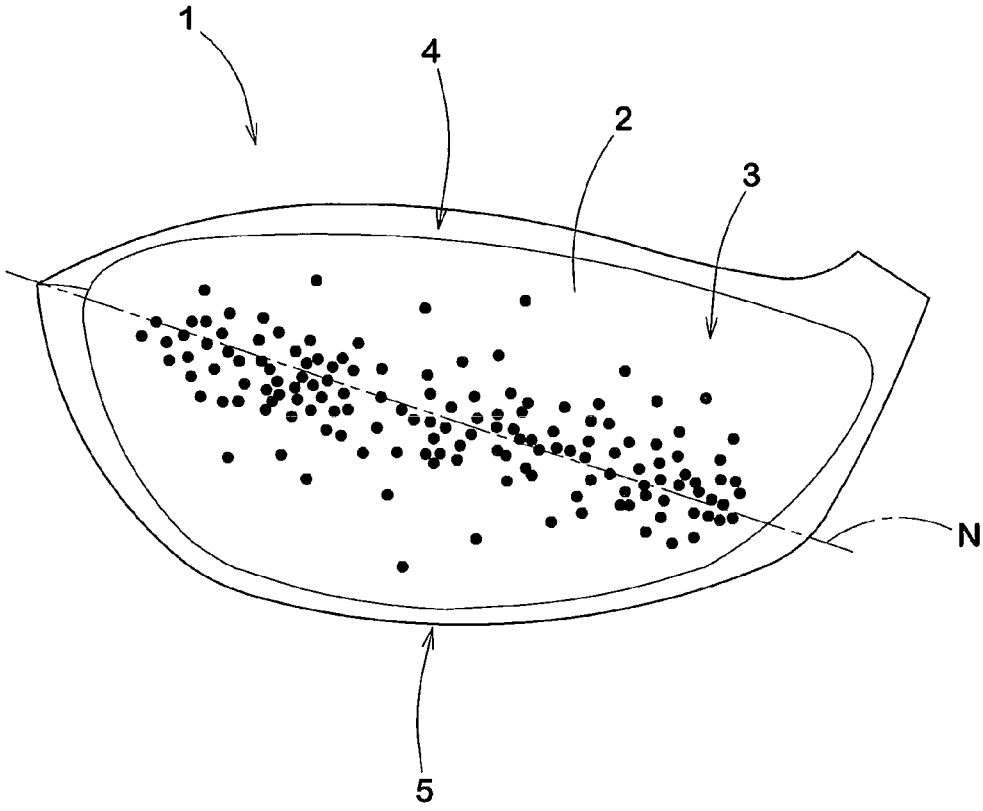
FIG. 7 is a diagrammatic view showing one example of a distribution chart of hit positions of average golfers.

In addition, as shown by black circles in FIG. 7, hit positions of an average golfer are distributed in a concentrated manner along a straight line N which is inclined to the side of the sole portion 5 (lower side) from the toe side to the heel side. Therefore, provision of the upper face rib 11*a* on the heel side and the lower face rib 12*a* on the toe side can control reduction of the resilience performance by sufficiently bending the face portion 3 even during a mishit, which thus enables reduction in flight distances of hit balls to be minimized.

In addition, as shown in FIG. 4, the width centerline of the respective face ribs 11*a*, 12*a* is defined as a straight line a3-b3 which connects a midpoint a3 of a straight line a1-a2 and a midpoint b3 of a straight line b1-b2, by obtaining intersection points a1, a2 of the central thick-walled part 10 and each face rib 11*a*, 12*a* and intersection points b1, b2 of the ribs and the peripheral edge 3*e* of the back surface of the face portion. Then, the extended lines K1 and K2 are obtained by extending the width centerline to the sole portion 5 or the crown potion 4.

As shown in FIG. 3, it is desired that, when viewed from the front as described above, the extended line k1 is inclined toward the toe side from the side of the crown portion to the side of the sole portion and at an angle θ1 of 10 to 40 degrees to the vertical line. Similarly, it is desired that the extended line K2 is inclined toward the toe side from the side of the crown portion to the side of the sole portion and at an angle θ2 of 10 to 40 degrees to the vertical line. With this, as the upper face rib 11*a* and the lower face rib 12*a* are oriented to a direction almost orthogonal to the straight line N, durability of the face portion 3 is further improved.

In addition, it is desired that each width Wfu, Wfd of the upper face rib 11*a* and the lower face rib 12*a* is formed smaller than the maximum width we of the central thick-walled part 10. This can reliably improve strength of the central region of the face portion 3 and prevent a reduction in a coefficient of restitution of the club head. From such a standpoint, it is desired that the ratio Wfu/Wc and the ratio Wfd/Wc of each width are preferably 0.2 or more and more preferably 0.25 or more or preferably 0.5 or less and more preferably 0.45 or less.

In the embodiment, for thickness of each portion of the crown-side thick-walled rib 11, the sole-side thick-walled rib 12, the crown rib 11*b*, and the sole rib 12*b*, that satisfying the following expressions (1) to (3) is desirable:

$$Tru, Trd > Tcrt \quad (1)$$

$$Tru, Trd > Tsrt \quad (2)$$

$$Tsrt > Tcrt \quad (3)$$

The symbols are as follows:

Tcrt: Average thickness of the crown rib (mm)

Tsrt: Average thickness of the sole rib (mm)

More specifically, as shown in FIG. 6A and FIG. 6B, the crown rib 11*b* has the average thickness Tcrt which is smaller than the average thickness of each thick-walled rib 11 and 12. In addition, similarly, the sole rib 12*b* has the average thickness Tsrt which is smaller than the average thickness of each thick-walled rib 11 and 12. Such a head 1 can ensure rigidity of the face portion 3 on which great impact acts when a golf ball is hit. Furthermore, the head increases rigidity of the crown portion 4 and the sole portion 5 while controlling any increase in the mass of the crown portion 4 and the sole portion 5. Therefore, in the embodiment, easiness to swing of the club head 1 is ensured by controlling excessive increase in the mass of the head 1 while ensuring durability of the head 1.

From the standpoint of ensuring the function effect mentioned above, it is desired that a ratio Tru/Tcrt of the average thickness of the crown-side thick-walled rib 11 and the average thickness of the crown rib 11*b*, and a ratio Trd/Tcrt of the average thickness of the sole-side thick-walled rib 12 and the average thickness of the crown rib 11*b* are preferably 1.2 or more and more preferably 1.23 or more, or preferably 1.5 or less and more preferably 1.45 or less. Similarly, it is desired that a ratio Tru/Tsrt of the average thickness of the crown-side thick-walled rib 11 and the average thickness of the sole rib 12*b* and a ratio Trd/Tsrt of the average thickness of the sole-side thick-walled rib 12 and the average thickness of the sole rib 12*b* are preferably 1.1 or more and more preferably 1.15 or more, or preferably 1.45 or less and more preferably 1.4 or less.

In addition, since the sole portion 5 comes into contact with the ground in many chances during a swing, it is required to have greater rigidity than the crown portion 4. Therefore, the sole portion 5 is reinforced and durability improves, by making thickness of the sole rib 12*b* greater than the thickness of the crown rib 11*b*, as in the expression (3). In addition, as the mass of the sole portion 5 is greater than the mass of the crown portion 4, the center of gravity of the head 1 can be lowered.

In addition, as the mass of the crown portion is too much when the ratio Tcrt/Tsrt of the average thicknesses of the crown rib 11*b* and the sole rib 12*b* increases, the head's center of gravity may be higher. In contrast, when the ratio Tcrt/Tsrt is small, the reinforcing effect on the crown portion 4 may degrade and durability may not be ensured. From such a standpoint, it is desired that the ratio Tcrt/Tsrt is preferably 0.7 or more and more preferably 0.73 or more, and preferably 0.95 or less and more preferably 0.9 or less.

To have the function effect mentioned above work, it is desirable to provide actual thickness of each rib in addition to provision of the average thickness, although the actual thickness is not particularly limited. More specifically, it is desired that the actual thickness of the crown-side thick-walled rib 11 is preferably 2.7 mm or more, and preferably 3.1 mm or less. In addition, the actual thickness of the sole-side thick-walled rib 12 is preferably 2.8 mm or more and preferably 3.1 mm or less. Similarly, it is desired that the actual thickness of the crown rib 11*b* is preferably 1.8 mm or more and preferably less than 2.7 mm. Similarly, it is desired that the actual thickness of the sole rib 12*b* is preferably 2.0 mm or more and preferably less than 2.8 mm.

In addition, as shown in FIG. 5, in the reference state, the crown rib 11*b* is provided on one side of the toe side or the heel side (the heel side in the embodiment) to the vertical plane P1 in the head front-back direction passing through the sweet spot SS. In addition, the sole rib 12*b* is provided on the other side of the toe side or the heel side (the toe side in the embodiment) to the vertical plane P1. This is because if the crown rib 11*b* and the sole rib 12*b* are formed only on any one side of the toe side or heel side to the vertical plane P1, the head weight is biased to the one side and thus the center of gravity G of the head 1 moves considerably. Such a club is not preferred because the club characteristic widely changes. In addition, the "head front-back direction" shall be a direction, in the reference state, at right angle to the vertical plane VP in which the axis centerline CL of the shaft insertion hole 7*a* is contained.

In addition, as the crown rib 11*b* and the sole rib 12*b* of the embodiment are formed to sandwich the center of gravity G of the head 1 in the toe-heel direction, the weight of the crown rib 11*b* and the weight of the sole rib balance each other, a position of the center of gravity of the head 1 does not change easily. Therefore, in the head 1 of the embodiment, a distance of the center of gravity GK does not change much and any change of the club characteristics is kept low. In addition, the "distance of the center of gravity GK" is the shortest distance from the axis centerline CL of the shaft insertion hole 7*a* to the head's center of gravity G.

In addition, in the planar view, the crown rib 11*b* and the sole rib 12*b* of the embodiment extend parallel to each other and for substantially the same length in the head front-back direction. In addition, as described above, the sole rib 12*b* has a thickness greater that of than the crown rib 11*b*. Thus, such a club head 1 can lower the center of gravity of the head 1, while improving durability of the sole portion 5 which comes into contact with the ground in many chances when a golf ball is hit. In addition, the "substantially the same length" includes a case in which lengths of the crown rib 11*b* and of the sole rib 12*b* are exactly the same or a case in which length from the vertical plane VP to an end of the crown rib 11*b* and length from the vertical plane VP to the sole rib 12*b* are the same.

In addition, as shown in FIG. 6A and FIG. 6B, when length Lu of the crown rib 11*b* and length Ld of the sole rib 12*b* are too small in the front-back direction of the head 1, it is difficult to improve durability of the crown portion 4 and/or the sole portion 5. In contract, when they are too great, the mass of the head 1 may increase and swinging may be difficult. From such a standpoint, it is desired that the lengths Lu and Ld is preferably 5% or more and more preferably 7% or more, and preferably 20% or less and more preferably 18% or less, of the maximum length L of the head 1 in the front-back direction.

In addition, it is desired that width Wcr of the crown rib 11*b* and width Wsr of the sole rib 12*b* in the toe-heel direction (maximum width if they change) is preferably 7 mm or more and more preferably 10 mm or more, and preferably 25 mm or less and more preferably 20 mm or less. In addition, from the standpoint of controlling concentrated load on the peripheral edge 3*ea* of the back surface of the face portion on which impact acts greatly when a golf ball is hit, it is desired that the upper face rib 11*a* and the crown rib 11*b* are connected with the same width in the toe-heel direction. Similarly, it is desired that the lower face rib 12*a* and the sole rib 12*b* are connected with the same width in the toe-heel direction.

In addition, it is desired that the average thickness Tcrt of the crown rib 11*b*, the average thickness Tsrt of the sole rib 12*b*, the thickness Tct of the boundary part 3*a* between the face portion 3 and the crown portion 4, and the thickness Tst of the boundary part 3*b* of the face portion 3 and the sole portion 4 satisfy the following expressions:

$$Tcrt, Tsrt > Tct$$

$$Tcrt, Tsrt > Tst$$

The club head 1 provided with the crown-side thick-walled rib 11 and the sole-side thick-walled rib 12 extending from the face portion 3 to the crown portion 4 and the sole portion 5, respectively, increase rigidity of the boundaries 3*a* and 3*b* which have relatively low rigidity. Therefore, the head 1 of the embodiment can make the thickness Tct of the boundary part 3*a* and the thickness Tst of the boundary part 3*b* smaller than a conventional head 1, thereby improving resilience performance.

More specifically, the thickness Tct of the boundary part 3*a* is desirably 1.3 mm or less. Similarly, the thickness Tst of the boundary part 3*b* is desirably 1.5 mm or less. In addition, as durability may deteriorate when both thicknesses Tct and Tst are small, the thickness Tct is desirably 0.8 mm or more and thickness Tst is desirably 1.0 mm or more.

In the embodiment, the crown-side thick-walled rib 11, the sole-side thick-walled rib 12, and the thin-walled part 13 are set as those satisfying the following expressions (6) to (8):

$$Tc > Tp \quad (6)$$

$$Tru, Trd > Tp \quad (7)$$

$$Tp > Tcrt, Tsrt \quad (8)$$

The symbols are as follows:

Tp: Average thickness of the thin-walled part (mm)

In other words, the average thickness Tp of the thin-walled part 13 provided in the face portion 3 is greater than the crown rib 11*b* provided in the crown portion 4 and the sole rib 12*b* provided in the sole portion 5. In such a head 1, durability and easiness to swing a club improve because weight is reduced while rigidity of the face portion 3 is ensured.

In addition, the thin-walled part 13 of the embodiment includes a toe-side thin-walled part 14 provided on the toe side of the central thick-walled part 10 and a heel-side thin-walled part 15 provided on the heel side of the central thick-walled part 10. The toe-side thin-walled part 14 includes a toe-side intermediate thin-walled part 14*a*, a toe-crown-side thin-walled part 14*b* provided between the toe-side intermediate thin-walled part 14*a* and the upper face rib 11*a*, and a toe-sole-side thin-walled part 14*c* provided between the toe-side intermediate thin-walled part 14*a* and the lower face rib 12*a*.

In addition, a heel-side thin-walled part 15 includes a heel-side intermediate thin-walled part 15*a* provided on the heel side of the central thick-walled part 10, a heel-crown-side thin-walled part 15*b* provided between the heel-side intermediate thin-walled part 15*a* and the crown-side thick-walled rib 11, and a heel-sole-side thin-walled part 15*c* provided between the heel-side intermediate thin-walled part 15*a* and the sole-side thick-walled rib 12.

when the average thickness Tp of the thin-walled part 13 becomes small, durability of the face portion 2 deteriorates. In contrast, when it increases, deflection of the face portion 3 becomes small, and loss in a flight distance may increase. From such a standpoint, it is desired that the average thickness Tp of the thin-walled part 13 is preferably 1.9 mm or more and more preferably 2.0 mm or more, and preferably 2.6 mm or less and more preferably 2.5 mm or less. In addition, to have the function effect described above work, it is desired that actual thickness Tp1 of the thin-walled part 13 is preferably 2.0 mm or more and preferably 2.4 mm or less, although the actual thickness is not particularly limited.

In addition, the toe-side intermediate thin-walled part 14*a* of the embodiment is formed to be thinner than the toe-crown-side thin-walled part 14*b* and the toe-sole-side thin-walled part 14*c*. Similarly, the heel-side intermediate thin-walled part 15*a* is formed to be thinner than the heel-crown-side thin-walled part 15*b* and the heel-sole-side thin-walled part 15*c*. This reduces weight of the face portion 3. In addition, this causes the thin-walled part 13 of the face portion 3 to sufficiently bend even during a mishit in which a golf ball is hit by the toe side or the heel side of the face portion 2, thus ensuring resilience performance. In addition, the thin-walled part 13 of the present invention is not limited to such an aspect, and may all be of the same thickness.

When thickness Tt of the toe-side intermediate thin-walled part 14*a* and thickness Th of the heel-side intermediate thin-walled part 15*a* are too small, durability of the face portion 3 may deteriorate. On the other hand, when respective thicknesses Tt and Th are too great, deflection of the face portion 3 during a mishit is damaged, and thus loss in a flight distance may increase. From such a standpoint, it is desired that the thicknesses Tt and Th of respective intermediate thin-walled parts 14*a* and 15*a* are preferably 1.7 mm or more and more preferably 1.9 mm or more, and preferably 2.3 mm or less and more preferably 2.2 mm or less.

In addition, it is desired that a ratio Tc/Tt of the thickness Tc of the central thick-walled part 10 and the thickness Tt of the toe-side intermediate thin-walled part 14*a* and a ratio Tc/Th of the thickness Tc of the central thick-walled part 10 and the thickness Th of the heel-side intermediate thin-walled part 15*a* are preferably 1.4 to 2.0. Although a difference in thickness increases and resilience performance becomes high if the ratios become greater, stress may concentrate between the thin-walled part 14*a* or 15*a* and the central thick-walled part 10. In contrast, if the ratios become smaller, the resilience performance may degrade.

In addition, as shown in FIG. 4 and FIG. 6, the face portion 3 of the embodiment contains a first thickness transition part 20 whose thickness smoothly decreases toward the peripheral edge 3*e* of the back surface of the face portion and which extends annually, around the central thick-walled part 10. Furthermore, on both sides of the upper face rib 11*a* are provided second thickness transition parts 21 whose thicknesses smoothly decrease from the upper face rib 11*a* toward the thin-walled parts 14*b* and 15*b* on both sides thereof. Similarly, on both sides of the lower face rib 12*a* are provided third thickness transition parts 22 whose thicknesses smoothly decrease from the lower face rib 12*a* toward the thin-walled parts 14*c* and 15*c* on both sides thereof. In addition, on both sides of the toe-side intermediate thin-walled part 14*a* are provided fourth thickness transition parts 23 whose thicknesses smoothly increase from the toe-side intermediate thin-walled part 14*a* toward the thin-walled parts 14*b* and 14*c* on both sides thereof. Similarly, on both sides of the heel-side intermediate thin-walled part 15*a* are provided fifth thickness transition parts 24 whose thicknesses smoothly increase from the heel-side intermediate thin-walled part 15*a* to the thin-walled parts 15*b* and 15*c* on both sides thereof.

Each of thickness transition parts 20 to 24 helps in improving durability of the face portion 3 by preventing generation of a great rigidity step resulting from a difference in thickness of each part, and preventing stress concentration.

In FIG. 8(*a*) and FIG. 8(*b*), a planar view of a reference state is shown as other embodiments of the present invention. In FIG. 8(*a*), a crown rib 11*a* and a sole rib 12*b* extend in a direction in which they are spaced apart from each other to a back face BF side. Such a club head 1 has both ribs 11*b*, 12*b* greater than the club head 1 shown in FIG. 5. Therefore, durability further improves. In addition, FIG. 8(*b*) shows an aspect in which a crown rib 11*b* and a sole rib 12*b* intersect each other and extend to a back face BF side. In such a club head 1, as both ribs 11*b* and 12*b* are formed larger than those of the club head 1 as shown in FIG. 8(*a*), durability improves. In addition, in FIG. 8 and FIG. 9, only the crown rib 11*b* and the sole rib 12*b* are shown, and an upper face rib 11*a* and a lower face rib 12*a* are not shown, as a matter of convenience.

In addition, in FIG. 9(*a*) and FIG. 9(*b*), other embodiments of the present invention are further shown. In FIG. 9(*a*), a crown rib 11*b* and a sole rib 12*b* form an arc. A center of the arc is on a heel side, preferably on an axis centerline CL of a shaft insertion hole 7*a*. In such a club head, while durability is improved, movement of a distance of a center of gravity GK of a head 1 is smaller than that of the club head 1 of FIG. 5. Therefore, such a club head is desirable because it can control any change in club characteristics. In FIG. 9(*b*), widths of a crown rib 11*b* and a sole rib 12*b* in a toe-heel direction gradually increase toward a back face BF. As such a club head 1 can move head's center of gravity G to the back face side, depth of the center of gravity GL increases, and thus the club head has excellent directional stability. In addition, the embodiment is not limited to such an aspect, it may take a shape in which the crown rib 11*b* gradually widens to the back face BF and the sole rib 12*b* gradually narrows, or a shape in which the crown rib 11*b* and the sole rib 12*b* both gradually narrows. In addition, the "depth of the center of gravity" is a horizontal distance between head's center of gravity and a leading edge.

Although the embodiments of the present invention have been described above, the present invention should not be limited to the specific embodiments mentioned above. For example, a club head 1 may be configured by a plate-like face member without an extension, and a head main portion provided with an opening on a front face, to which the face member can be attached (not shown).

EXAMPLE

Based on the specification of Table 1 and configurations of FIG. 1 to FIG. 4, a golf club head of wood type is manufactured, and resilience performance and durability performance thereof were tested. Except for specification of a face back surface, specifications of all the embodiments and comparative examples are made identical. More specifically, as shown in FIG. 2, each head has a two-piece structure formed by Tig welding a head main portion including a lost-wax precision casting of Ti-6AI-4V and a cup-shaped face member including a hot forging of Ti-6AI-4V. In addition, head volume is 460 $cm^3$ and all area of the face back surface is 42.0 $cm^2$.

Listed below are common specifications:

Head mass: uniformed to 190.5 g (Driver (1#))

Maximum width of a central thick-walled part in a toe-heel direction: 35 mm

Average thickness of a crown-side thick-walled rib: 2.85 mm, actual thickness, 2.75 to 2.95 mm Average thickness of a sole-side thick-walled rib: 2.9 m mm, actual thickness, 2.8 to 3.0 mm Width of the crown-side thick-walled rib in the toe-heel direction: 7 to 15 mm Width of the sole-side thick-walled rib in the toe-heel direction: 7 to 15 mm Width of an upper side face rib in the toe-heel direction: 10 to 25 mm Width of a lower side face rib in the toe-heel direction: 10 to 25 mm Average thickness of the upper face rib: 2.0 mm, actual thickness 1.8 to 2.4 mm Average thickness of the lower face rib: 2.4 mm, actual thickness of 2.0 to 2.6 mm Average thickness of a thin-walled part: 2.15 mm A method for testing is as follows:

<Resilience Performance>

A resilience coefficient was determined, in accordance with Procedure for Measuring the velocity Ratio of a Club Head for Conformance to Rule 4-1e, Revision 2 (Feb. 8, 1999). However, measurement positions are five locations: in addition to a sweet spot, a toe-side position and a heel-side position, respectively spaced 20 mm on a toe side and a heel side from the sweet spot, and a crown-side position and a sole-side position, respectively spaced 10 mm upward and downward from the sweet spot. Values indicated are indices with resilience coefficients of the sweet spot as 100 in each example, and are averages of 4 locations, excluding the sweet spot. The greater a numeric value is, the better the resilience performance is.

<Durability Performance>

45-inch wood-type golf clubs were manufactured experimentally by mounting each test head to a carbon shaft (sv-3003J, flex x) made by SRI Sports Limited. The club was attached to a swing robot made by Miyamae Co., Ltd., and hit golf balls with the sweet spot of the face at a head speed of 54 m/s. Till the head was broken, the number of hits (the upper limit was set to 10,000 hits) was counted. In addition, it was checked whether or not there was damage by stopping hitting every 10 balls, and observing the head with the naked eyes. The greater the number of hits is, the better the durability performance is.

Table 1 shows test result.

As a result of the test, it could be checked that the club of the embodiment had a small reduction rate of resilience performance and was good. In other words, it could be checked that loss in a flight distance could be kept low even if hit ball positions fluctuate. Also, it could be checked that the durability performance was good.

TABLE 1

| | Comparative Example 1 | Example 1 | Example 2 | Comparative Example 2 | Example 3 | Example 4 | Example 5 | Example 6 | Example 7 | Example 8 |
|---|---|---|---|---|---|---|---|---|---|---|
| Figure showing structure of club head | FIG. 5 | FIG. 5 | FIG. 5 | FIG. 5 | FIG. 5 | FIG. 5 | FIG. 5 | FIG. 5 | FIG. 5 | FIG. 5 |
| Thickness of central thick-walled part (mm) | 3.0 | 3.5 | 3.6 | 4.5 | 3.4 | 3.4 | 3.4 | 3.4 | 3.4 | 3.4 |
| Ratio of length of crown rib Lu/L (%) | 0 | 2 | 3 | 3 | 8 | 10 | 25 | 7 | 7 | 10 |
| Ratio of length of sole rib Ld/L (%) | 0 | 3 | 3 | 5 | 10 | 10 | 30 | 12 | 15 | 12 |
| Average thickness of crown rib (mm) | 0 | 2.1 | 2.1 | 2.1 | 2.1 | 2.1 | 2.1 | 2.1 | 2.1 | 2.1 |
| Average thickness of sole rib (mm) | 0 | 1.7 | 1.7 | 1.7 | 1.7 | 1.7 | 1.7 | 1.7 | 1.9 | 2.1 |
| Average thickness of boundary part between face portion and crown portion (mm) | 0.8 | 0.8 | 0.8 | 0.8 | 0.7 | 0.7 | 0.8 | 0.8 | 0.8 | 0.8 |
| Average thickness of boundary part between face portion and sole portion (mm) | 0.9 | 0.9 | 1.0 | 0.9 | 0.9 | 0.9 | 1.0 | 1.0 | 0.9 | 1.0 |
| Resilience performance (coefficient) | 90 | 87 | 83 | 69 | 88 | 87 | 85 | 90 | 89 | 88 |
| Durability (number of hits) | 2450 | 4160 | 6780 | 8200 | 4510 | 5070 | 5550 | 4740 | 7320 | 7650 |

Figure 8A:
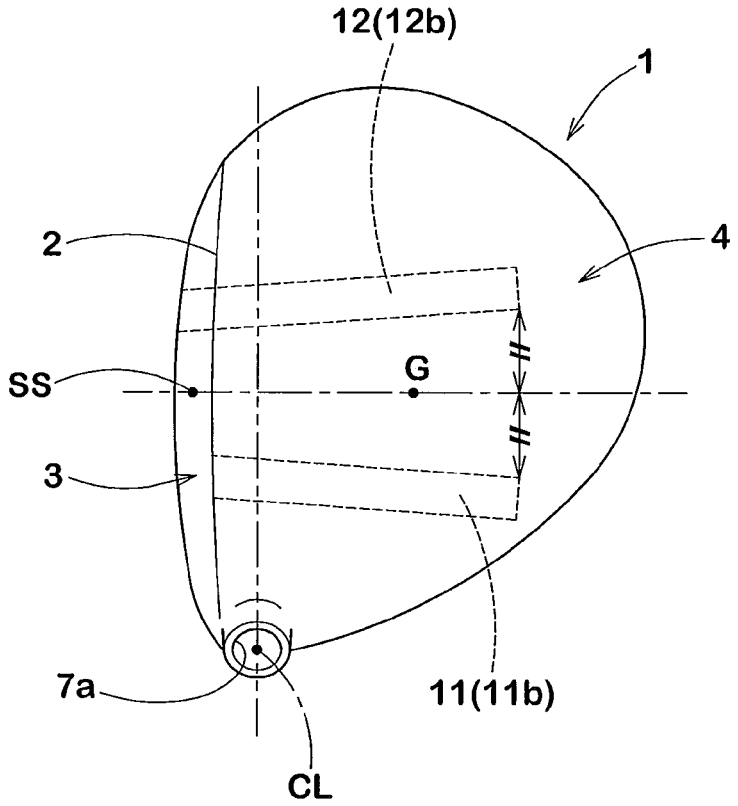
FIG. 8(*a*) and FIG. 8(*b*) are plane views of a head showing other embodiments of the present invention.
Figure 8B:
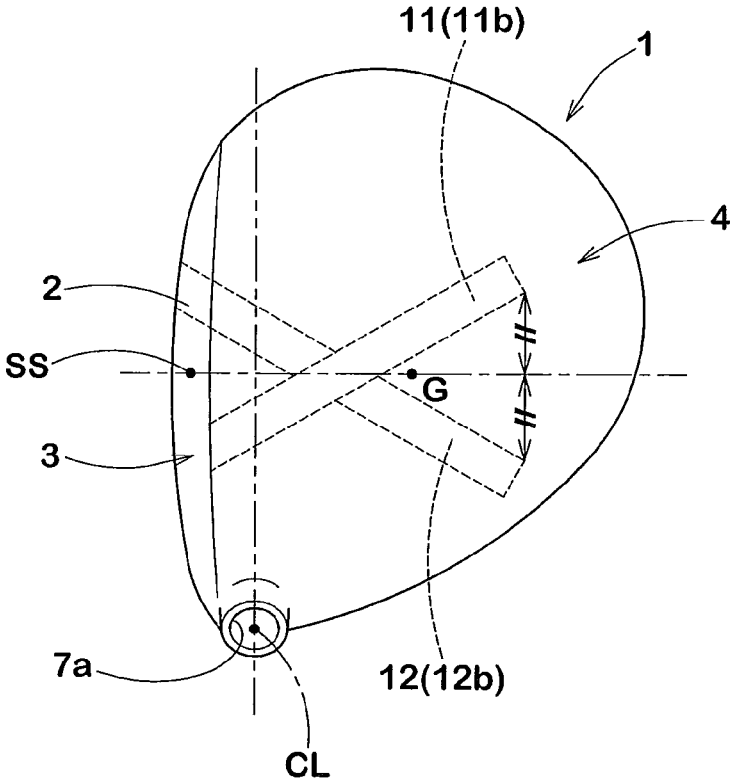
Figure 9A:
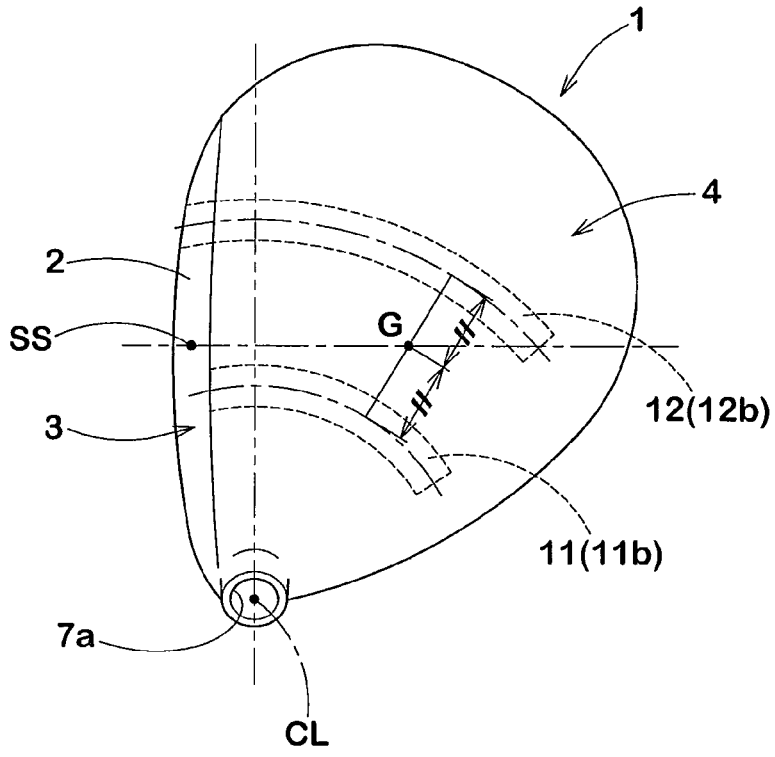
FIG. 9(*a*) and FIG. 9(*b*) are plane views of a head showing still other embodiments of the present invention.
Figure 9B:
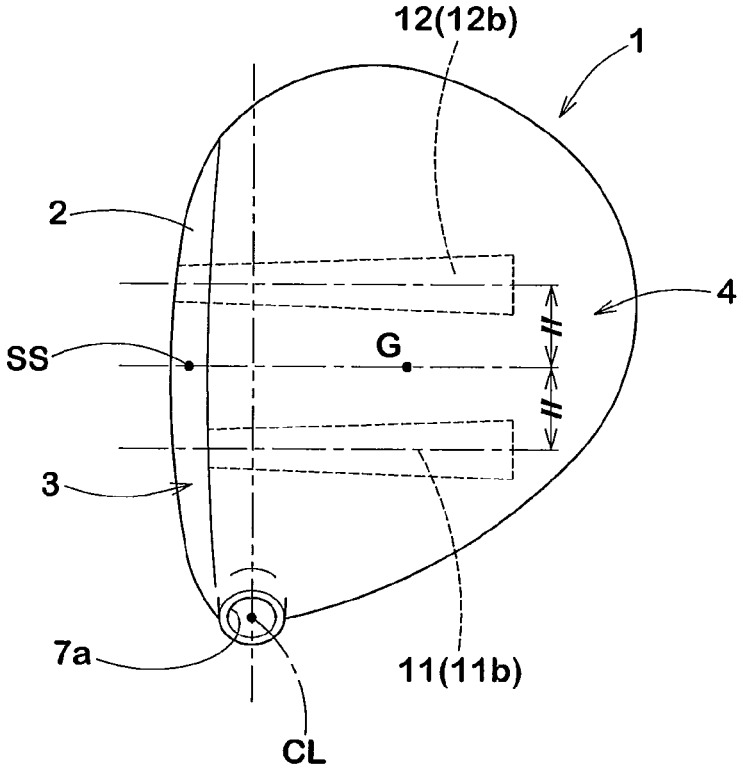

| | Example 9 | Example 10 | Example 11 | Example 12 | Example 13 | Example 14 | Example 15 | Example 16 | Example 17 | Example 18 |
|---|---|---|---|---|---|---|---|---|---|---|
| Figure showing structure of club head | FIG. 5 | FIG. 5 | FIG. 5 | FIG. 5 | FIG. 5 | FIG. 5 | FIG. 8(a) | FIG. 8(b) | FIG. 9(a) | FIG. 9(b) |
| Thickness of central thick-walled part (mm) | 3.5 | 3.4 | 3.4 | 3.4 | 3.4 | 3.5 | 3.5 | 3.5 | 3.5 | 3.5 |
| Ratio of length of crown rib Lu/L (%) | 8 | 8 | 7 | 7 | 8 | 8 | 8 | 8 | 8 | 8 |
| Ratio of length of sole rib Ld/L (%) | 15 | 13 | 11 | 12 | 10 | 11 | 14 | 12 | 12 | 12 |
| Average thickness of crown rib (mm) | 2.2 | 2.1 | 2.2 | 2.1 | 2.1 | 2.1 | 2.2 | 2.1 | 2.0 | 2.0 |
| Average thickness of sole rib (mm) | 2.9 | 2.4 | 2.5 | 2.4 | 2.4 | 2.5 | 2.4 | 2.4 | 2.3 | 2.4 |
| Average thickness of boundary part between face portion and crown portion (mm) | 0.7 | 0.8 | 0.9 | 1.3 | 1.5 | 1.1 | 1.2 | 1.2 | 1.2 | 1.1 |
| Average thickness of boundary part between face portion and sole portion (mm) | 0.9 | 1.0 | 1.0 | 1.5 | 1.8 | 1.4 | 1.4 | 1.4 | 1.5 | 1.5 |
| Resilience performance (coefficient) | 87 | 90 | 91 | 89 | 87 | 91 | 90 | 91 | 90 | 91 |
| Durability (number of hits) | 8070 | 8490 | 9630 | 10000 | 10000 | 10000 | 10000 | 10000 | 10000 | 10000 |

What is claimed is:

1. A golf club head having a hollow structure comprising a face portion which has a face to hit a golf ball, a crown portion which connects to an upper edge of the face and forms a top surface of the head, a sole portion which connects to a lower edge of the face and forms a bottom surface of the head, and a side portion between the crown portion and the sole portion, which extends from a toe-side edge of the face to a heel-side edge of the face through a back face of the head, wherein the face portion is provided in a central region thereof with a central thick-walled part having a thickness of 3.1 to 4.2 mm, and an inner surface of the head including a back surface of the face portion is provided with a crown-side thick-walled rib and a sole-side thick-walled rib, the crown-side thick-walled rib including an upper face rib which is disposed in the face portion and extends from the central thick-walled part to a peripheral edge of said back surface of the face portion on a crown portion side, and a crown rib which is disposed in the crown portion and extends backwardly of the head from the upper face rib, and the sole-side thick-walled rib including a lower face rib which is disposed in the face portion and extends from the central thick-walled part to a peripheral edge of the back surface of the face portion on a sole portion side and a sole rib which is disposed in the sole portion and extends backwardly of the head from the lower face rib, wherein the following expressions are satisfied:

$$Tc \geq Tru,$$

$$Tc \geq Trd,$$

$$Wc \geq Wru, \text{ and}$$

$$Wc \geq Wrd,$$

wherein

Tc is a thickness of the central thick-walled part,

Wc is a maximum width of the central thick-walled part in the toe-heel direction, Wru is a width of the crown-side thick-walled rib in the toe-heel direction, Wrd is a width of the sole-side thick-walled rib in the toe-heel direction, Tru is an average thickness of the crown-side thick-walled rib, and Trd is an average thickness of the sole-side thick-walled rib.

2. The golf club head according to claim 1, wherein the following expressions are satisfied:

$$Tru > Tcrt,$$

$$Trd > Tcrt,$$

$$Tru > Tsrt,$$

$$Trd > Tsrt, \text{ and}$$

$$Tsrt > Tcrt,$$

wherein

Tru is the average thickness of the crown-side thick-walled rib,

Trd is the average thickness of the sole-side thick-walled rib,

Tcrt is an average thickness of the crown rib, and

Tsrt is an average thickness of the sole rib.

3. The golf club head according to claim 1, wherein the face portion is further provided with a thin-walled part having a thickness of from 1.9 to 2.6 mm, and the following expressions are satisfied:

$$Tc > Tp,$$

$$Tru > Tp,$$

$$Trd > Tp,$$

$$Tp > Tcrt, \text{ and}$$

$$Tp > Tsrt,$$

wherein

Tp is an average thickness of the thin-walled part.

Tc is the thickness of the central thick-walled part,

Tru is the average thickness of the crown-side thick-walled rib,

Trd is the average thickness of the sole-side thick-walled rib,

Tcrt is the average thickness of the crown rib, and

Tsrt is the average thickness of the sole rib.

4. A golf club head having a hollow structure comprising a face portion which has a face to hit a golf ball, a crown portion which connects to an upper edge of the face and forms a top surface of the head, a sole portion which connects to a lower edge of the face and forms a bottom surface of the head, and a side portion between the crown portion and the sole portion, which extends from a toe-side edge of the face to a heel-side edge of the face through a back face of the head, wherein the face portion is provided in a central region thereof with a central thick-walled part having a thickness of 3.1 to 4.2 mm, and an inner surface of the head including a back surface of the face portion is provided with a crown-side thick-walled rib and a sole-side thick-walled rib, the crown-side thick-walled rib including an upper face rib which is disposed in the face portion and extends from the central thick-walled part to a peripheral edge of said back surface of the face portion on a crown portion side, and a crown rib which is disposed in the crown portion and extends backwardly of the head from the upper face rib, and the sole-side thick-walled rib including a lower face rib which is disposed in the face portion and extends from the central thick-walled part to a peripheral edge of the back surface of the face portion on a sole portion side and a sole rib which is disposed in the sole portion and extends backwardly of the head from the lower face rib, wherein in a reference state in which the club head is set on a horizontal plane at its lie angle and loft angle, the crown rib is disposed on one side of a vertical plane, and the sole rib is provided on the other side of the vertical plane, wherein the vertical plane is defined as including a sweet spot of the face and being parallel with the front-back direction of the head.

* * * * *